US006350316B1

(12) United States Patent
Hayashi et al.

(10) Patent No.: US 6,350,316 B1
(45) Date of Patent: Feb. 26, 2002

(54) APPARATUS FOR FORMING COATING FILM

(75) Inventors: Shinichi Hayashi, Kumamoto; Shinji Nagashima, Kikuchi-gun, both of (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/425,298

(22) Filed: Oct. 25, 1999

(30) Foreign Application Priority Data

Nov. 4, 1998 (JP) ..... 10-312802
Nov. 4, 1998 (JP) ..... 10-312971

(51) Int. Cl.[7] ..... B05C 5/02
(52) U.S. Cl. ..... 118/52; 118/56; 118/66; 118/69; 118/319; 118/320
(58) Field of Search ..... 118/52, 56, 319, 118/320, 66, 69; 427/240; 134/902

(56) References Cited

U.S. PATENT DOCUMENTS 5,038,707 A * 8/1991 Swain et al. ..... 118/319
5,470,802 A * 11/1995 Gnade et al. ..... 437/238
5,779,799 A * 7/1998 Davis ..... 118/319
6,129,042 A * 10/2000 Smith et al. ..... 118/694
6,239,859 B1 * 5/2001 Park ..... 118/52

FOREIGN PATENT DOCUMENTS

DE 689 02 833 4/1993
DE 689 04 071 6/1993
DE 197 30 898 7/1998
JP 11-176825 7/1999
JP 11-204514 7/1999

* cited by examiner

*Primary Examiner*—Laura Edwards
(74) *Attorney, Agent, or Firm*—Oblon, Spivak, McClelland, Maier & Neustadt, P.C.

(57) ABSTRACT

An apparatus for forming a coating film, comprising a process section for applying a series of processes for forming a coating film to a substrate, and a common transfer mechanism for transferring a substrate in the process section, in which, the process section comprises a cooling unit for cooling a substrate, a coating unit for applying a coating solution containing a first solvent to the substrate to form a coating film, an aging unit for changing the coating film formed in the coating unit to a gel-state film if the coating film is formed in a sol state, a solvent exchange unit for bringing a second solvent, which differs from the first solvent in composition, into contact with the coating film to replace the first solvent contained in the coating film with the second solvent, a curing process unit for heating and cooling the substrate under an atmosphere low in oxygen concentration, thereby curing the coating film, and a heating unit for heating the coating film formed on the substrate.

19 Claims, 8 Drawing Sheets

APPARATUS FOR FORMING COATING FILM

BACKGROUND OF THE INVENTION

The present invention relates to an apparatus for forming a coating film by applying a coating solution onto a substrate to form an insulating film such as an interlayer dielectric film in a manufacturing step for a semiconductor device.

A manufacturing process for a semiconductor device includes a step of forming an interlayer dielectric film on a metal wiring layer made of aluminium or copper, or between metal wiring layers. The interlayer dielectric film is known to be formed by various methods including a Sol-Gel method, a SiLk method, a SPEED FILM method, and a FOx method.

In the Sol-Gel method, a sol (colloid solution) having TEOS (tetraetoxysilane; $Si(OC_2H_5)_4$) dispersed in an organic solvent, is spin-coated on a surface of a semiconductor wafer. Then, the coated sol is changed into a gel (Gel processing). Furthermore, the solvent in the coating film is replaced with another solvent (solvent exchange processing), dried and baked. Through these steps, a desired interlayer dielectric film is obtained. In the gelation step, for example, ammonia is used as a chemical solution. In the solvent exchange processing, ammonia or hexamethyldisilazane (HMDS) is used as the chemical solution.

A chemical solution supply source of a conventionally used apparatus is arranged away from a process section so as not to have an adverse effect upon the process. Therefore, a long pipe is required for supplying a chemical solution from each supply source to the process section. However, if the pipe is long, the chemical solution present in gaseous form or vapor form is easily condensed in the pipe. As a result, the process may be adversely affected.

Since the waste liquid/exhaust gas line passes under the process section in a conventional device, the waste solution or chemical components contained in an exhaust gas may have an adverse effect upon the process in the process section. Furthermore, from a safety/health point of view, it is not preferable that the waste liquid/exhaust gas line is arranged under the process section.

In the SiLK method, SPEED FILM method, and FOx method, a coating solution is applied to a cooled wafer, heated, cooled, and further heated and cooled in an atmosphere low in oxygen concentration. Through these steps, the coating film is cured to obtain an interlayer dielectric film.

In the meantime, different types of interlayer dielectric films are sometime required to be formed on the same wafer. To describe more specifically, an interlayer dielectric film having a high relative dielectric constant (high K) and an interlayer dielectric film having a low relative dielectric constant (low K) are required to be formed on the same wafer in some cases. In such cases, a method suitable for a type of interlayer dielectric film is selected from the Sol-Gel method, SiLK method, SPEED FILM method, and FOx method. Based on these technical background, a single device capable of forming various types of interlayer dielectric films has been strongly demanded. Furthermore, a device is required for forming an interlayer dielectric film with a high throughput in accordance with any one of the methods.

BRIEF SUMMARY OF THE INVENTION

An object of the present invention is to provide an apparatus for forming a coating film capable of forming various types of the coating films with a high throughput in a single apparatus.

Another object of the present invention is to provide an apparatus for forming a coating film, having no adverse effect on a process when a chemical solution is supplied to the process section and an exhaust gas and a waste liquid are discharged from the process section.

According to the present invention, there is provided an apparatus for forming a coating film comprising; a process section for applying a series of processes for forming a coating film, to a substrate; and a common transfer mechanism for transferring a substrate in the process section.

The process section comprises a cooling unit for cooling a substrate; a coating unit for applying a coating solution containing a first solvent to the substrate to form a coating film; an aging unit for changing the coating film formed in the coating unit to a gel-state film when the coating film is formed in a sol-state; a solvent exchange unit for bringing a second solvent, which differs from the first solvent in composition, into contact with the coating film to replace the first solvent contained in the coating film with the second solvent; a curing process unit for heating and cooling the substrate under an atmosphere low in oxygen concentration, thereby curing the coating film; and a heating unit for heating the coating film formed on the substrate.

Furthermore, the apparatus comprises a carrier station provided next to the process section for loading/unloading an unprocessed substrate and a processed substrate into/from the process section; and a transfer section for transferring a substrate between the carrier station and the process section.

The process section may have at least two coating units.

The process section has a first coating unit for coating an adhesion promoter solution low in viscosity on a substrate and a second coating unit for coating an interlayer dielectric film formation solution high in viscosity on a substrate.

The process section has at least two aging units and at least two curing process units.

The solvent exchange unit, the coating unit, the aging unit are arranged next to each other.

Furthermore, the apparatus may have a side cabinet provided next to the process section.

The side cabinet comprises a bubbler for generating a vapor of a chemical liquid and supplying the vapor of a chemical liquid generated, to the aging unit; a trap section for trapping a waste and a discharge gas derived from the solvent exchange unit, the aging unit, and the coating unit; and a drain section for discharging a liquid component separated from a gaseous component in the trap section.

In this case, the bubbler is arranged next to the heating unit.

It is preferable that the process section have a first coating unit for coating an adhesion promoter solution low in viscosity, on a substrate and a second coating unit for coating an interlayer dielectric film solution high in viscosity, on the substrate; and each of the first coating unit and the solvent exchange unit is arranged next to the side cabinet.

The side cabinet is preferably isolated from the carrier station by the process section.

The second coating unit preferably has temperature control means for controlling a temperature of the interlayer dielectric film forming solution.

The solvent exchange unit has temperature control means for controlling the second solvent.

According to the present invention, there is provided an apparatus for forming a coating film comprising, a process section for applying a series of processes for forming a coating film, to a substrate; and a common transfer mechanism for transferring the substrate in the process section.

The process section comprises a first process unit group including a coating unit for coating a coating solution containing a first solvent on the substrate; and a solvent exchange unit for bringing a second solvent, which differs from the first solvent in composition, into contact with the coating film to replace the first solvent in the coating film with the second solvent, and a second process unit group including a cooling unit for cooling the substrate; a heating unit for heating the substrate; an aging unit for changing the coating film into a gel-state film if the coating film is formed in a sol state in the coating unit; and a curing process unit for heating and cooling the substrate under an atmosphere low in oxygen concentration to cure the coating film.

The common transfer mechanism is provided next to the first and second process unit groups, for transferring a substrate to at least a coating unit, solvent exchange unit, cooling unit, heating unit, aging unit, and curing process unit.

According to the present invention, there is provided an apparatus for forming a coating film comprising, a process section for applying a series of processes for forming a coating film, to a substrate; a common transfer mechanism for transferring the substrate in the process section; and a chemical liquid section provided next to the process section while isolated therefrom.

The process section comprises a coating unit for coating a coating solution of a sol state having particles or colloid dispersed in a solvent, onto the substrate; an aging unit for changing the particles or colloid in the coating film into a gel; and a solvent exchange unit for replacing a solvent in the coating film with another solvent.

The chemical liquid section has a chemical liquid supply system for supplying a chemical liquid to each of the aging unit and the solvent exchange unit; and a waste liquid/gas process system for discharging a waste liquid and an exhaust gas derived from the aging unit and the solvent exchange unit.

The solvent exchange unit, the coating unit and the aging unit are arranged next to each other.

The chemical liquid section generates a vapor of the chemical liquid and has a bubbler for supplying the vapor of the chemical liquid to the aging unit.

The chemical liquid section has a tank for storing the chemical liquid to be supplied to the solvent exchange unit.

The chemical liquid section may have a drain tank for trapping a waste discharged from the aging unit; and a trap section communicating with the drain tank and the solvent exchange unit for separating the waste discharged from the solvent exchange unit into a gaseous component and a liquid component, and sending the liquid component separated, to the drain tank.

According to the present invention, there is provided an apparatus for forming a coating film comprising, a process section having at least a coating process unit for coating a coating solution onto a substrate, and a chemical solution process unit for processing a coating film formed in the coating process unit, with a chemical solution; and a chemical liquid section arranged next to the process section while isolated therefrom.

The chemical liquid section has a chemical liquid supply system for supplying a chemical liquid to the chemical liquid process unit; and an exhaust gas/waste process system for processing a waste liquid and an exhaust gas derived from the chemical liquid process unit.

In a case where an interlayer dielectric film is formed in the Sol-Gel method, a substrate is transported sequentially to the cooling unit, coating process unit, aging unit, solvent exchange unit, and heating unit.

In a case where an interlayer dielectric film is formed by the SiLK method and SPEED FILM method, a substrate is transferred to the cooling process unit, coating process unit (adhesion promoter coating), cooling process unit, coating process unit (main chemical liquid coating), heating unit, cooling unit, and curing process unit.

In a case where an interlayer dielectric film is formed by the FOx method, a substrate is transferred sequentially to the cooling unit, coating unit, heating unit, cooling unit, and a curing unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, various preferred embodiments of the present invention will be described with reference to the accompanying drawing.

The SOD (Spin on Dielectric) system has a process section 1, a side cabinet 2, and a carrier station (CSB) 3. The process section 1 is provided between the side cabinet 2 and the carrier station (CSB) 3.

Figure 1A:
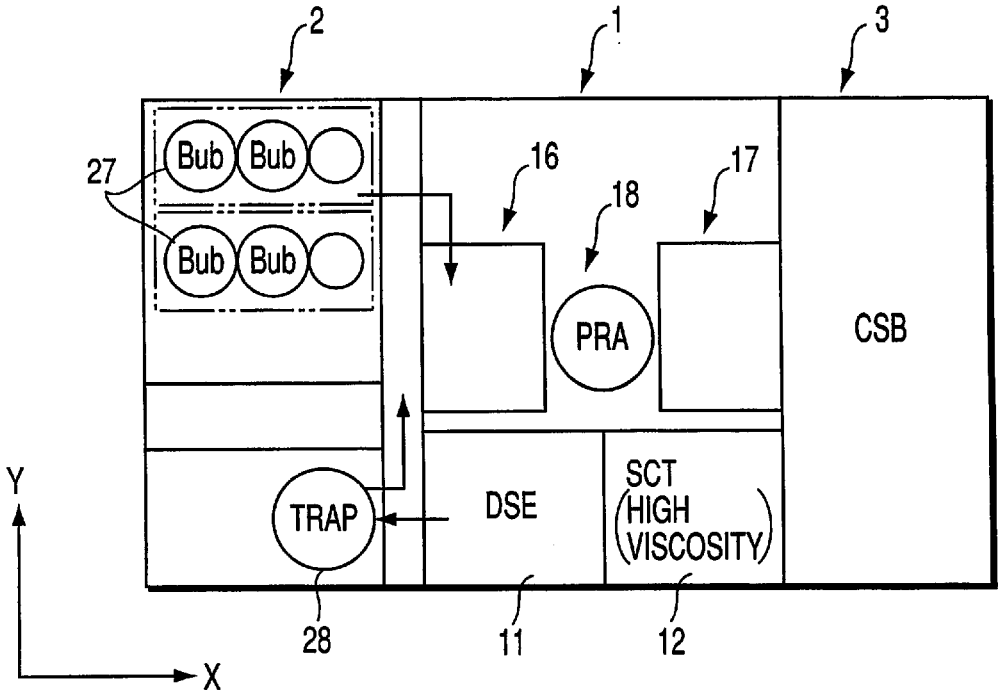
FIGS. 1A and 1B are schematic plan views respectively showing an upper stage and a lower stage of a coating film formation apparatus (SOD system) according to an embodiment of the present invention.
Figure 1B:
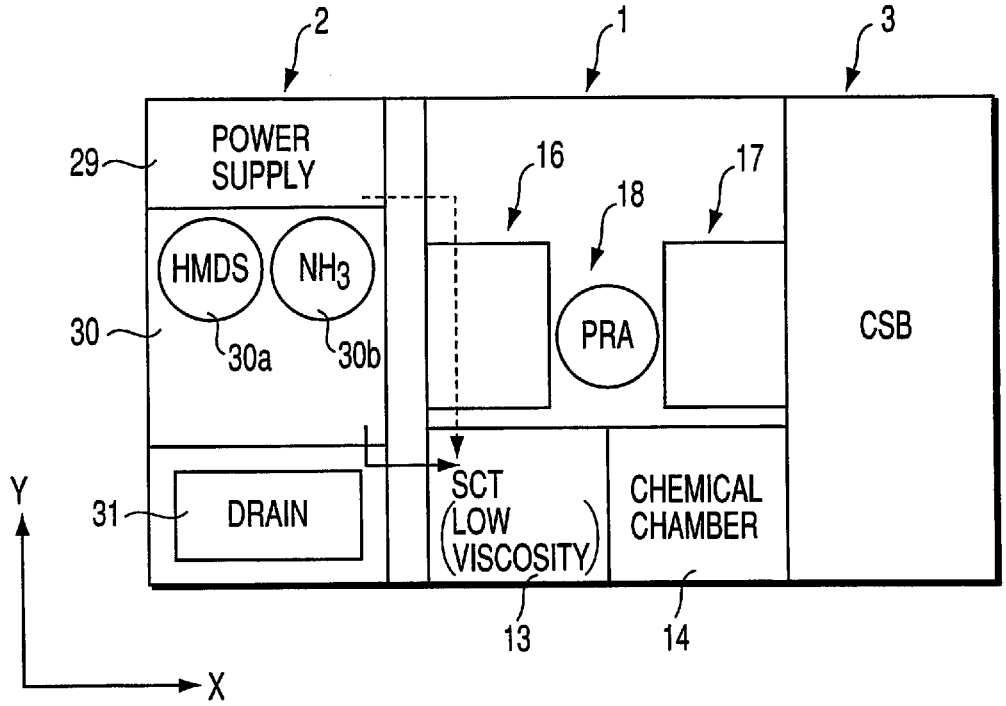
Figure 2:
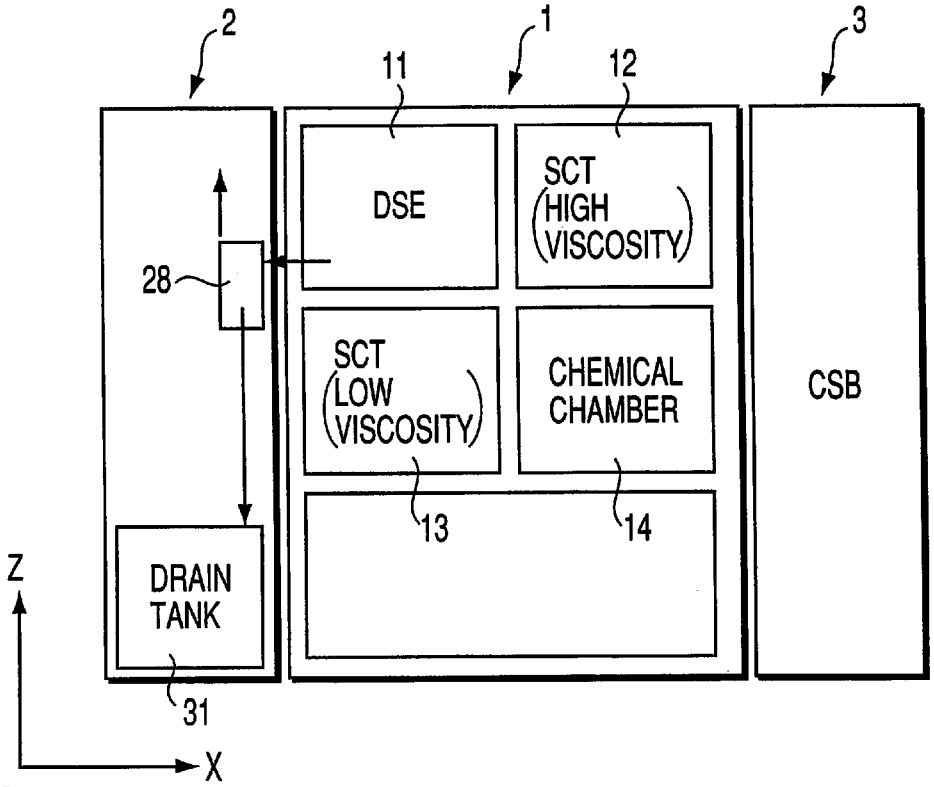
FIG. 2 is a schematic plan view showing various units arranged in a front surface of the coating film formation apparatus (SOD system)

As shown in FIGS. 1A and 2, a solvent exchange unit (DSE) 11 and a coating process unit (SCT) 12 are arranged at a front side in an upper stage of the process unit 1. As shown in FIGS. 1B and 2, a coating process unit (SCT) 13 and a chemical chamber 14 are arranged at a front side in a lower stage of the process section 1. The coating process unit (SCT) 12 has a coating solution supply source (not shown) storing a high-viscosity coating solution. The coating process unit (SCT) 13 has a coating solution supply source 47 (refer to FIG. 4) storing a coating solution low in viscosity. The chemical chamber 14 stores various chemical solutions.

Figure 3:
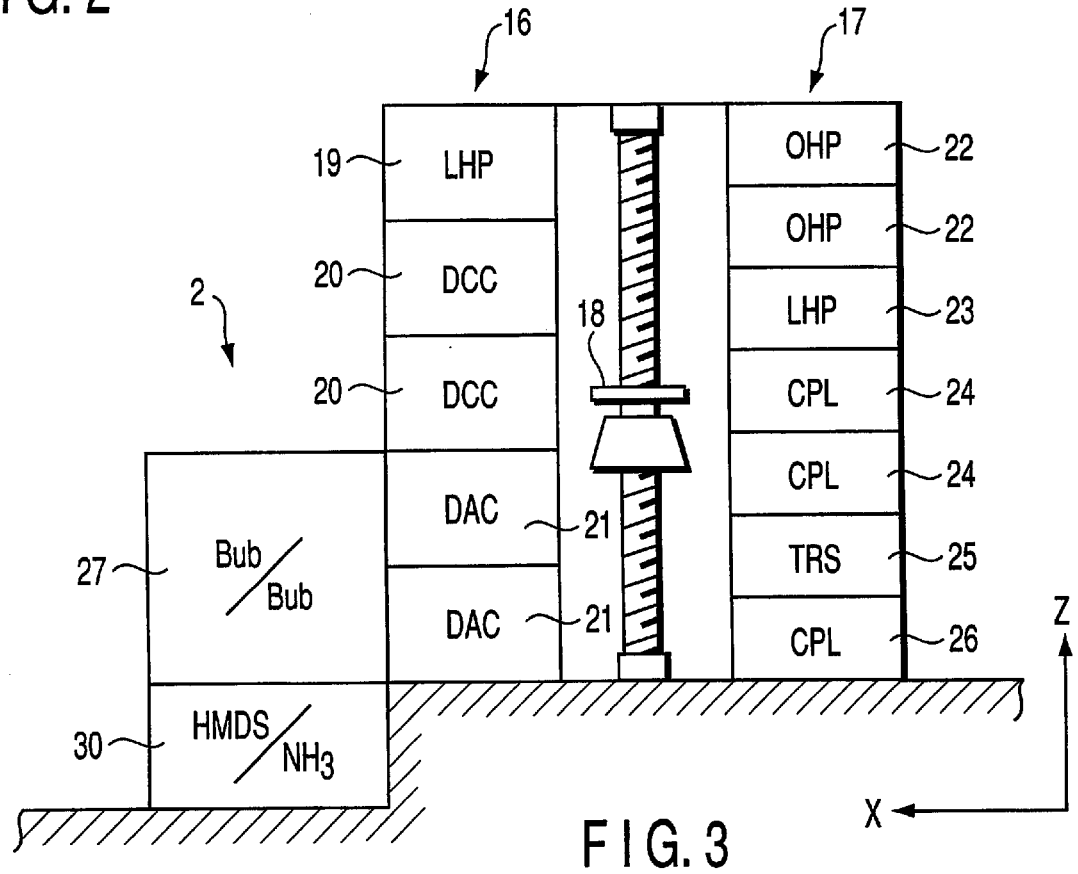
FIG. 3 is a schematic plan view showing various units arranged in a rear surface of the coating film formation apparatus (SOD system)

In a center portion of the process section 1, process unit groups 16, 17 and a transfer mechanism (PRA) 18 are provided as shown in FIGS. 1A and 1B. The process unit groups 16, 17 consist of a plurality of process units 19–26 which are stacked vertically in multiple stages, as shown in FIG. 3. The transfer mechanism 18 is liftably provided between the process unit group 16 and the process unit group 17 and responsible for transferring the wafer W to each of the process units 19, 20, 21, 22, 23, 24, 25, 26.

In the process unit group 16, a hot plate unit (LHP) 19 for low temperature heating, two DCC process units (Dielectric Oxygen Density Controlled Cure and Cooling off) 20 serving as a curing process unit and two aging units (DAC) 21 are arranged in this order from the above. In the process unit group 17, two hot plate units (OHP) 22 for high temperature heating, hot plate unit (LHP) 23 for low temperature heating, two cooling plate units (CPL) 24, a transfer unit (TRS) 25, and cooling plate unit (CPL) 26 are arranged in the order from the above. Note that the transfer unit (TRS) may have a cooling function.

As shown in FIG. 1A, four bubblers 27 are arranged at a rear side in an upper stage of the side cabinet 2. As shown in FIGS. 1B and 3, a power supply source 29 and a chemical solution chamber 30 are provided at the rear side in the lower stage. The chemical solution chamber 30 has an HMDS supply source 30*a* and an ammonia gas supply source 30*b*. A trap 28 is provided at a front side in the upper stage of the side cabinet 2. An exhaust gas from the DSE unit 11 is cleaned in the TRAP 28. A drain 31 is provided at the front side in the lower stage of the side cabinet 2. A waste solution from the TRAP 28 is discharged in the drain 31.

Figure 7:
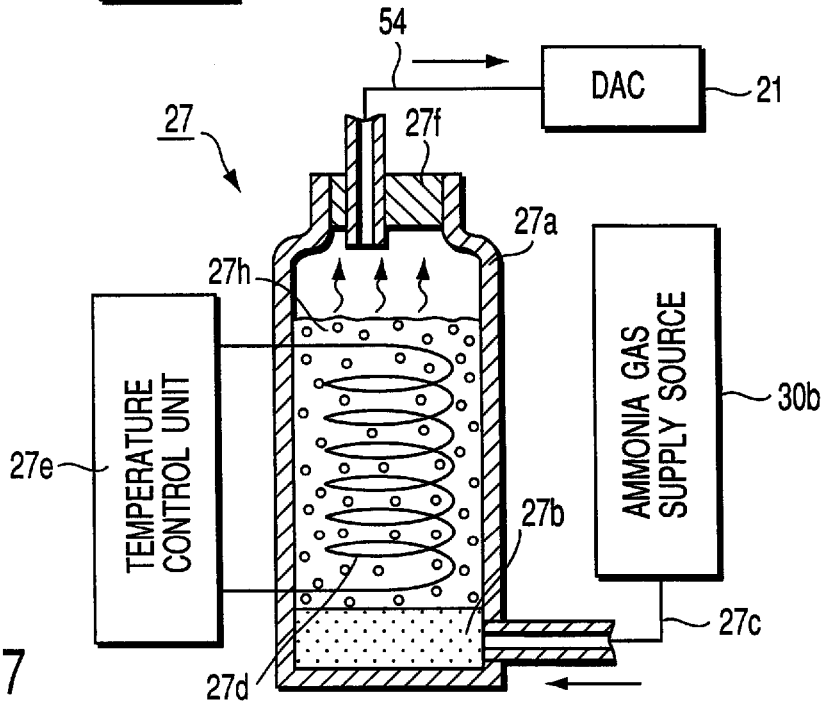
FIG. 7 is a schematic sectional view of a bubbler (Bub) with a block diagram of peripheral elements.

As shown in FIG. 7, the bubbler 27 has a vessel 27*a* storing ammonia water 27*h*, a porous plug 27*b* formed at a bottom of the vessel 27*a*, a thermal exchange portion 27*d*, and a cover 27*f*. The porous plug 27*b* is formed of porous ceramic and communicates with an ammonia gas supply source 30*b* of the chemical solution chamber 30 by way of a pipe 27*c*. The thermal exchange portion 27*d* is dipped in ammonia water 27*h* contained in the vessel 27*a* and controlled by a temperature control unit 27*e*. A vapor generating section (upper space) of the vessel 27*a* communicates with the aging unit (DAC) 21 by way of a pipe 54.

Ammonia gas is supplied from the gas supply source 30*b* to a porous plug 27*b*. When ammonia gas is blown into ammonia water 27*h*, bubbling with the gas occurs, with the result that water vapor ($H_2O$) containing a hydroxy group ($OH^-$) is generated. The water vapor ($H_2O$) containing a hydroxy group ($OH^-$) is supplied to the aging unit (DAC) 21 through the pipe 54. The bubbler 27 is desirably arranged near the process unit group 16 including the heating process unit in order to prevent condensation of the generated water vapor. Furthermore, the side cabinet 2 is desirably arranged at the longest possible distance from the carrier station (CSB) 3 so that ammonia or HMDS does not have an effect upon the side cabinet 2.

The carrier station (CSB) 3 has a cassette mounting table (not shown) and a sub-transfer mechanism (not shown). A plurality of wafer cassettes are mounted on the cassette mounting table. A cassette is loaded and unloaded into the cassette mounting table by a transfer robot (not shown). The cassette stores unprocessed semiconductor wafers W or processed semiconductor wafers W. The sub transfer mechanism takes out an unprocessed wafer W and transfers it into a unit (TRS) 25 of the process section 1, and then receives a processed wafer W from the unit (TRS) 25 and loads into the cassette.

Then, we will explain a case where an interlayer dielectric film is formed by using the SOD system in accordance with the Sol-Gel method.

In the Sol-Gel method, a wafer W is processed in the cooling plates (CPL) 24, 26, second coating process unit (SCT) 13, aging unit (DAC) 21, solvent exchange unit (DSE) 11, hot plates (LHP) 19, 23 and hot plate (OHP) 22 in this order mentioned. When the interlayer dielectric film is formed by the Sol-Gel method, the second coating process unit (SCT) 13, the aging unit (DAC) 21, and the solvent exchange unit (DSE) 11 are mainly used.

Next, the coating process unit (SCT) 13 for low-viscosity coating solution will be explained with reference to FIG. 4.

The coating process unit (SCT) 13 has a nozzle 46 communicating with a supply source 47 storing a low-viscosity coating solution. The low-viscosity coating solution is a sol solution consisting of TEOS colloid or particles dispersed in an organic solvent, to which water and a small-amount hydrochloric acid are further added. The process space 13*a* of the coating process unit (SCT) 13 is surrounded by a cover 41 and a cup 42. A vacuum chuck 45 is provided in the space 13*a*. The cover 41, which is movably and swingably supported by a moving mechanism (not shown), closes an upper opening of the cup 42. When the cover 41 is opened, the wafer W is mounted on the transfer mechanism 18 on a vacuum chuck 45.

The vacuum chuck 45 has an absorption hole communicating with a vacuum evacuation unit (not shown) and supported by a driving shaft 44 attached to the bottom of the cup 42 by way of a bearing 44*a*. The driving shaft 44 is rotatably and liftably connected by means of a driving portion 43. A nozzle 46 is attached to a center portion of the cover 41 and moved together with the cover 41.

A plurality of pipes 48 communicating with a solvent vapor supply source 49 pass through a side peripheral portion of the cup 42, for supplying ethylene glycol vapor to the process space 13*a*. Ethylene glycol is a solvent used in a coating solution. Openings of a drain pipe 49 and an exhaust pipe 50 are formed at the bottom of the cup 42. Note that the coating solution and the solvent to be used in the unit 13 are supplied from the chemical chamber 14. The chemical chamber 14 stores a chemical solution such as ammonia and HMDS. Since the supply sources such as ammonia and HMDS have an adverse effect upon the unit 13, it is isolated from other portions in the chemical chamber 14. Note that a coating process unit (SCT) 12 for a high-viscosity solution and a coating process unit (SCT) 13 for a low-viscosity solution, are formed in the same structure.

Figure 5:
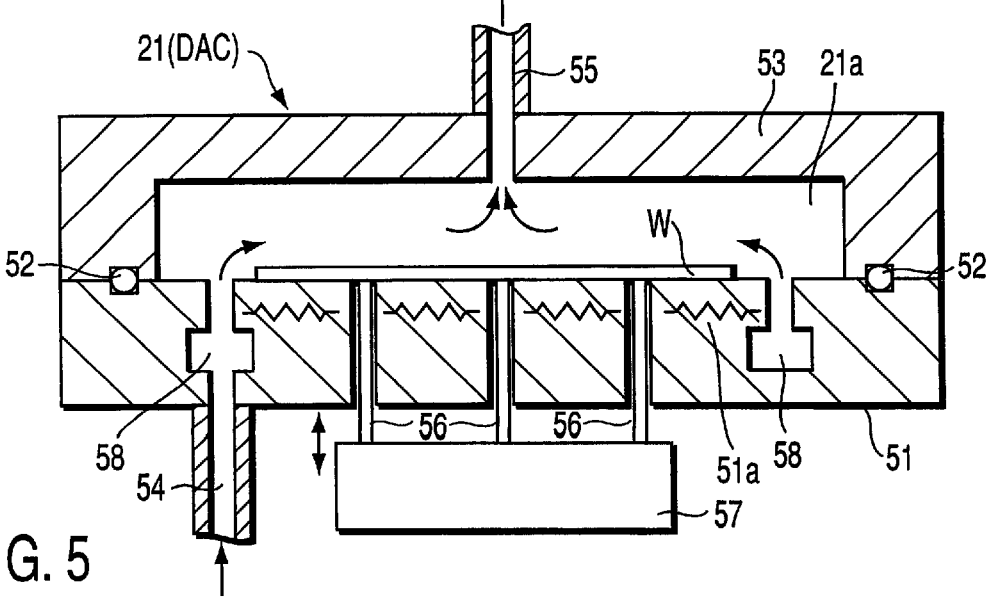
FIG. 5 is a perspective sectional view schematically showing an aging unit (DAC)

As shown in FIG. 5, a process space 21*a* of the aging unit (DAC) 21 is surrounded by an aging plate 51 and a cover 53. A ring form sealing member 52 is inserted into a contact portion between the heating plate 51 and the cover 53. The heating plate 51 is made of ceramic in which a heater 51*a* connecting to a power supply source (not shown) is buried. The cover 53 is liftably supported by a lift mechanism (not shown). When the cover 53 is opened by the lift mechanism, the wafer W is mounted on the heating plate 51 by the transfer mechanism 18. Three lift pins 56 are liftably supported by a cylinder mechanism 57 so as to protrude from an upper surface of the heating plate 51.

An opening of a ring-form gas flow passage 58 is formed at the upper surface of the heating plate 51 for supplying a gas around the wafer W mounted on the plate 51. The ring-form gas flow passage 58 communicates with the bubbler 27 by way of the pipe 54. An inlet port communicating with an exhaust pipe 55 is formed at a center of the cover 53 for evacuating the process space 21*a*. Note that the exhaust pipe 55 communicates with the drain tank 31 in the side cabinet 2.

Figure 6:
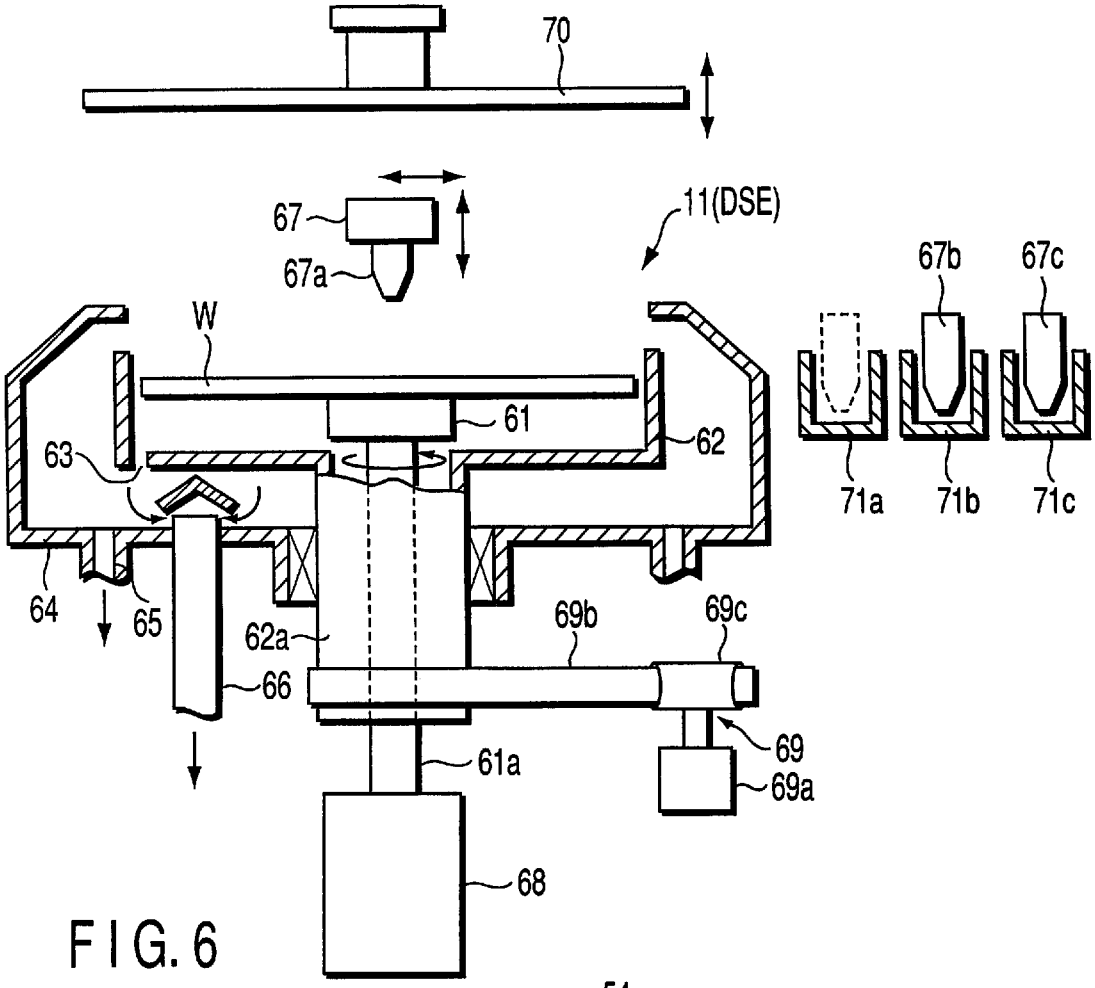
FIG. 6 is a perspective sectional view schematically showing a solvent exchange unit (DSE)

As shown in FIG. 6, the solvent exchange unit (DSE) 11 has a vacuum chuck 61, a rotation cup 62, a fixed cup 64, and a nozzle portion 67. An adsorption hole (not shown) communicating with a vacuum evacuation unit (not shown) is formed in an upper surface of the vacuum chuck 61. A lower portion of the vacuum chuck 61 is connected to a driving shaft 61*a* of a motor 68. A power source of the motor 68 (not shown) is connected to a controller 100 to control a rotation speed of the vacuum chuck 61.

A lower portion 62*a* of the rotation cup is a hollow tube. A belt 69*b* of the rotation drive mechanism 69 is stretched between the lower portion 62*a* of the rotation cup and a pulley 69*c* to transmit a rotation driving force from a motor 69*a* to the rotation cup 62. Note that a driving shaft 61*a* is connected to the vacuum chuck 61 through a hollow portion of the rotation cup lower portion 62*a*. Furthermore, a drainage hole 63 is formed at the bottom of the cup 62 so as to surround the wafer W on the chuck 61.

The fixed cup 64 is provided so as to surround the rotation cup 62. A discharge passage 65 and an exhaust passage 66 are discretely formed at the bottom of the fixed cup 64. Drainage liquid drops and mist are discharged from the bottom opening 63 of the rotation cup to the fixed cup 64.

The nozzle portion 67 has three exchangeable nozzles 67*a*, 67*b*, 67*c*. The first nozzle 67*a* communicates with an ethanol supply source (not shown). The second nozzle 67*b* communicates with an HMDS supply source. The third nozzle 67*c* communicates with a heptane supply source (not shown). These exchangeable nozzles 67*a*, 67*b*, 67*c* are allowed to stand-by at respective nozzle receipt portions 71*a*, 71*b*, 71*c* provided in a home position. The nozzles 67*a*, 67*b*, 67*c* are taken out selectively from the respective nozzle receipt portions 71*a*, 71*b*, 71*c* by a nozzle chuck mechanism (not shown) and transferred above a rotation center of the wafer W. Such a nozzle chuck mechanism is disclosed in, for example, U.S. Pat. No. 5,089,305.

When HMDS is supplied to the second nozzle 67*b*, HMDS is directly supplied from the HMDS tank 30*a* of the side cabinet 2. A gas-liquid mixture is discharged from the cup 64 to a mist trap 28 through an exhaust passage 66 to separate gas from liquid. Furthermore, the waste water is discharged from the cup 64 through a discharge passage 65 to a drain tank 31.

The side cabinet 2 is provided next to the process section 1 while isolated therefrom. A bubbler 27 for supplying a chemical solution and a mist-trap (TRAP) 28 for discharging an exhaust gas by separating it from the gas-liquid mixture are provided in an upper stage of the side cabinet 2. The power supply source 29, chemical solution chambers 30 for storing chemical solutions such as HMDS and ammonia, and the drain 31 are arranged in a lower stage of the side cabinet 2.

When an alkaline vapor is supplied to the aging unit (DAC) 21, ammonia gas is blown from the tank 30*b* to the bubbler 27 to bubble the ammonia water in the bubbler 27. When HMDS is supplied to the solvent exchange unit (DSE) 11, HMDS is directly supplied from the tank 30*a* to the unit 11.

The exhaust gas from the aging unit (DAC) 21 is trapped by a drain tank 31 in the side cabinet 2. Furthermore, the exhaust gas mixed with liquid derived from the solvent exchange unit (DSE) 11 is separated into a gaseous component and a liquid component by the mist trap 28 in the cabinet 2 and the liquid component is discharged into the drain tank 31.

Since the aging unit (DAC) 21 and the solvent exchange unit (DSE) 11 are provided next to the side cabinet 2, a pipe for chemical solution supply can be shortened.

Immediately (e.g., within 10 seconds) after a sol solution is coated onto the wafer W, gelation treatment is preferably applied to change a sol state to a gel state. Therefore, as shown in FIGS. 1 to 3, the coating unit (SCT) 13 for a low viscosity coating solution and the aging unit (DAC) 21 are adjoined to each other. Since it is preferable that a solvent is immediately exchanged after the gelation treatment, the aging unit (DAC) 21 and the solvent exchange unit (DSE) 11 are adjoined to each other.

Note that the DCC process unit 20 is used for curing a coating film in the SiLK method, SPEED FILM method or FOx method, however, it is not required in the Sol-Gel method. The coating process unit (SCT) 12 is used for coating a high-viscosity coating solution but is not usually used in the Sol-Gel method.

Next, a case where an interlayer dielectric film is formed by the Sol-Gel method will be explained with reference to FIGS. 8A to 8C and 9.

First, a particulate material of tetraetoxysilane (TEOS) is prepared as alkoxide (Step S1). The TEOS particulate material is weighed (Step S2). Then, the TEOS particulate material is added to a solvent to prepare a sol having a predetermined composition (Step S3). As the solvent, any one of solvents including water, 4-methyl-2-pentanone, ethylalcohol, cyclohexanone and 1-Methoxy-2-Propanol, is used. Furthermore, water and a small-amount of hydrochloric acid are added to the sol to adjust the concentration of the sol to a final desired concentration (Step S4).

Figure 8A:
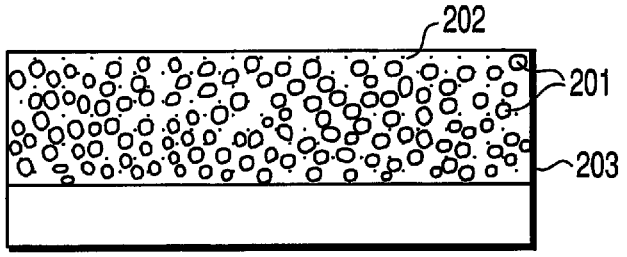
FIG. 8A is a schematic sectional view showing a sol-state coating film in a Sol-Gel method.

The sol thus prepared is stored in the coating solution supply source 47 of the coating process unit 13. The wafer W is held by the vacuum chuck 45. While the cover 41 is closed and a solvent vapor is supplied from the vapor supply source 49 into the cup 42, the cup 42 is evacuated. The wafer W is rotated, a sol is supplied to the wafer W from the nozzle 46 and spin-coated on the wafer W (Step S5). In this manner, a coating film having TEOS particles or colloid 201 dispersed in a solvent 202 is formed as shown in FIG. 8A. In this case, if a sol supply amount, a wafer rotation speed, a wafer temperature, a sol temperature, a solvent vapor supply amount, and a cup evacuation amount are individually controlled, the coating film can be formed in a desired thickness. It is desirable that the solvent vapor supplied from the solvent vapor supply source 49 should have the same composition as that of the solvent.

Figure 8B:
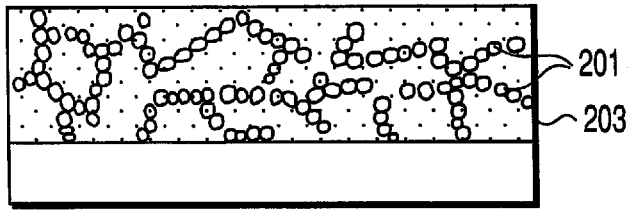
FIG. 8B is a schematic sectional view showing a gel-state coating film.

Then, the wafer W is transferred to the aging unit (DAC) 21 in which an alkaline vapor is applied to a coating film 203. Due to this, TEOS present in the coating film 203 is condensed and simultaneously hydrolyzed. As a result, a reticulated structure 201 is formed, as shown in FIG. 8B. In this manner, the coating film 203 is changed from a sol to a gel (STEP S6).

Then, the wafer W is transferred to the solvent exchange unit (DSE) 11 and another solvent 204 is applied to the coating film 203 therein. The solvent 202 present in the coating film 203 is replaced with another solvent 204 (Step S7). Through this step, a moisture content of the coating film 203 is substantially removed. As the solvent 204 used as a replacement solvent, 3-pentanone is used.

Figure 8C:
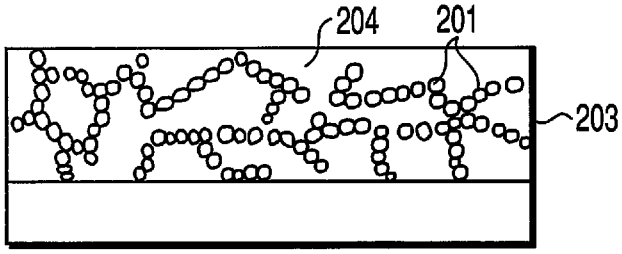
FIG. 8C is a schematic sectional view of a coating film in which an initial solvent is replaced with another solvent.
Figure 9:
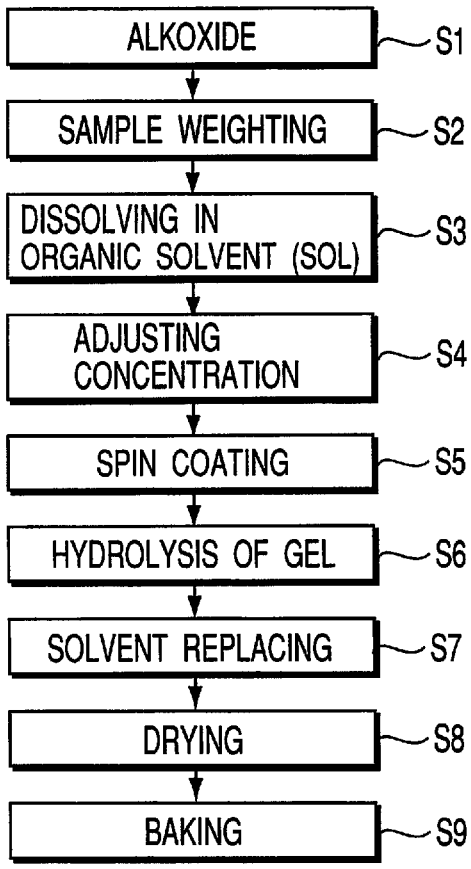
FIG. 9 is a flow chart showing an example of a Sol-Gel process.

Then, the wafer W is heated by the hot plate (LHP) 23 at a low temperature to dry the coating film (Step S8). Furthermore, the wafer W is heated by the hot plate (OHP) 22 at a high temperature to bake the coating film (Step S9). The coating film thus baked serves as an interlayer dielectric film, as shown in FIG. 8C.

Now, we will explain how to operate the SOD system in the case where the interlayer dielectric film is formed by the Sol-Gel method.

A wafer W transferred from the carrier station (CSB) 3 to the transfer section (TRS) 25 is transferred by the transfer mechanism 18 to the cooling plates (CRL) 24, 26 and cooled therein. In this manner, differences in temperature of the wafer surface before coating can be reduced. It is therefore possible to form the resultant film uniformly in thickness and quality.

Figure 4:
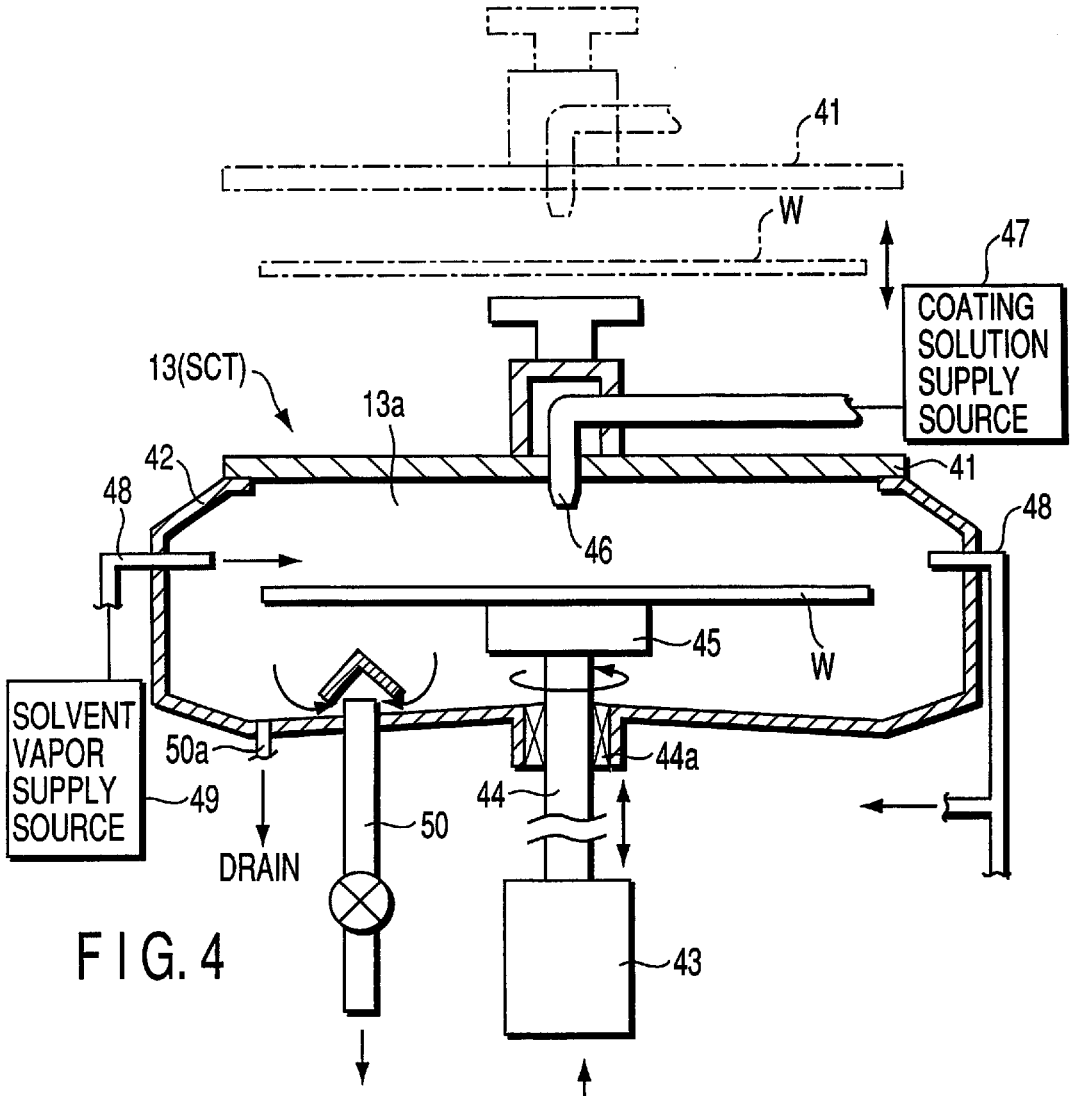
FIG. 4 is a perspective sectional view schematically showing a coating process unit (SCT) for a low viscosity solution.

Then, the wafer W is transferred to a coating process unit (SCT) 13 and then passed to the chuck 45 as shown in FIG. 4. Then, the rotation cup 42 is closed airtight by the cover 41. The coating solution used in the coating process unit 13 is a low viscosity solution formed of TEOS colloid or particles dispersed in an organic solvent, to which water and a small amount of hydrochloric acid are further added. While the rotation cup 4 is evacuated through the exhaust pipe 50, the vapor of the organic solvent is supplied from the solvent vapor supply pipe 48 to the rotation cup 42 to fill the rotation cup 42 with the organic solvent vapor. Thereafter, the evacuation is terminated and the coating solution is supplied dropwise from the nozzle 46 to a center portion of the wafer W. Then, while the wafer W is rotated by the chuck 45, the coating solution is spread over the entire surface of the wafer W. As a result, a coating film is formed. As described, the reason why the coating process is performed while the rotation cup 42 is filled with the organic solvent vapor is to suppress vaporization of the solvent from the coating solution.

The wafer W having a coating film formed thereon is transferred to the aging unit (DAC) 21. Since it is preferable to perform a gelation treatment for changing a sol to a gel immediately after the coating solution is coated on the wafer W, the aging unit (DAC) 21 is desirably arranged next to the coating process unit (SCT) 13 for a low viscosity solution.

In the aging unit (DAC) 21, the cover 53 is moved up to transfer the wafer W to a liftable pin 56 as shown in FIG. 5. As a result, the wafer W is arranged next to the heating plate 51. After the cover 53 is closed, ammonia is supplied from the bubbler 27 in the cabinet 2 to a process chamber S through the gas supply passage 54 while the aging unit is evacuated through the evacuation passage 55. At this time, the wafer W is heated at, e.g., 100° C. Through this heating, colloid contained in the coating film of the wafer W is gelatinized and continuously connected in a reticular form.

Then, the wafer W is transferred to the solvent exchange unit (DSE) 11. In this case, it is preferable to replace a solvent immediately after the gelation treatment, so that the aging unit (DAC) 21 and the solvent exchange unit (DSE) 11 are arranged next to each other.

In the solvent exchange unit (DSE) 11, the wafer W is transferred to the vacuum chuck 61 as shown in FIG. 6. Then, a water soluble chemical agent, e.g., ethanol, is supplied dropwise to a center of the wafer W from an exchange nozzle 67*a* of the nozzle 67. While the wafer W and the rotation cup 62 are rotated, ethanol is spread over the entire surface of the wafer W. Ethanol is dissolved in the moisture content of the coating film, with the result that the moisture content is replaced with ethanol.

Then, a cover 70 is opened and HMDS is supplied to the center portion of the wafer W in the same manner. In this way, a hydroxy salt contained in the coating film is removed. Furthermore, heptane is supplied dropwise to the wafer W to replace the solvent contained in the coating film with heptane. The reason why heptane is used is to reduce the force to be applied to a porous construct, e.g., the TEOS reticulate construct 201, by using a solvent having a small surface tension, thereby preventing destruction thereof.

Thereafter, the wafer W is heated by the hot plates (LHP) 19, 23 to a low temperature region and heated by the hot plate (OHP) 22 to a high temperature region. In these two-step baking, an interlayer dielectric film is completed. The wafer W is finally returned to the carrier station (CSB) 3 through a transfer section (TCP) 25.

In the apparatus of the aforementioned embodiment, since the side cabinet 2 having the HMDS tank 30*a*, the ammonia tank 30*b*, and the bubbler 29, is arranged next to the process section 1 having the aging unit (DAC) 21 and the solvent exchange unit (DSE) 11 which require these chemical solutions, it is possible to shorten the pipe 54 for supplying these chemical solutions. As a result, it is possible to prevent condensation of vapor on the chemical solution supply pipe 54. At the same time, it is possible to greatly reduce leakage of ammonia and HMDS to the outside. In addition, these chemical solution supply system (29, 30*a*, 30*b*) is surrounded by the side cabinet 2, and thereby isolated from the process section 1. Therefore, even if the chemical solution supply system (29, 30*a*, 30*b*) is arranged next to the process section 1, the system will not have no adverse effect upon the process section 1.

Furthermore, the mist trap (TRAP) 28 and the drain 31 are not arranged in the process section 1 but in the side cabinet 2, an exhaust gas and a waste solution rarely have an effect upon the process section 1.

As described, by arranging the side cabinet 2 having the supply system (29, 30*a*, 30*b*) of the chemical solution which may have an adverse effect upon the process, and the waste liquid/exhaust gas process system (28, 31) next to the process section 1, it is possible to prevent the chemical solution from having an adverse effect upon the process without fail.

In the apparatus of the aforementioned embodiment, since the aging unit (DAC) 21 using ammonia and HMDS and the solvent exchange unit (DSE) 11 are arranged at the closest distance from the waste liquid/exhaust gas process system (28, 31), the supply pipe and discharge pipe are reduced in length.

In the aforementioned aging unit (DAC) 21, ammonia is used. In the solvent exchange unit (DSE) 11, HMDS and heptane are used. However, the replacement solution is not limited to them.

Next, we will explain a case where an interlayer dielectric film is formed on the wafer W by using the SOD system in accordance with the SiLK method and SPEED FILM method.

In the cases of the SiLK method and the SPEED FILM methods, a coating film is formed by subjecting a wafer sequentially to the cooling plates (CPL) 24, 26, the first coating process unit (SCT) 13 (for coating an adhesion promoter solution), the hot plates (LHP) 19, 23 for a low temperature heating, the cooling plates (CPL) 24, 26, the second process unit (SCT) 12 (for coating a main chemical solution), the hot plates (LHP) for a low temperature processing 19, 23, the high temperature hot plate (OHP) 22, and the DCC process unit (DCC) 20.

Of these process units, the DCC process unit 20 is not required in the Sol-Gel method but required in the SiLK method and the SPEED FILM method.

Now, referring to FIGS. 10 to 13, the DCC process unit 20 serving as a curing apparatus will be explained.

Figure 10:
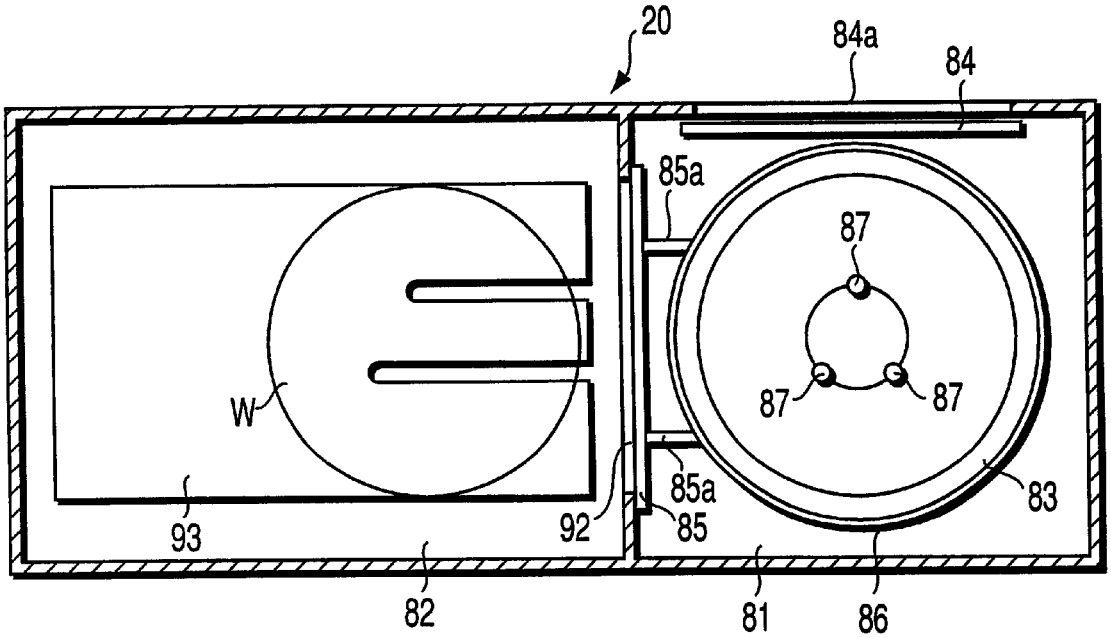
FIG. 10 is a perspective sectional view showing a curing process unit (DCC) as viewed from the above.
Figure 11:
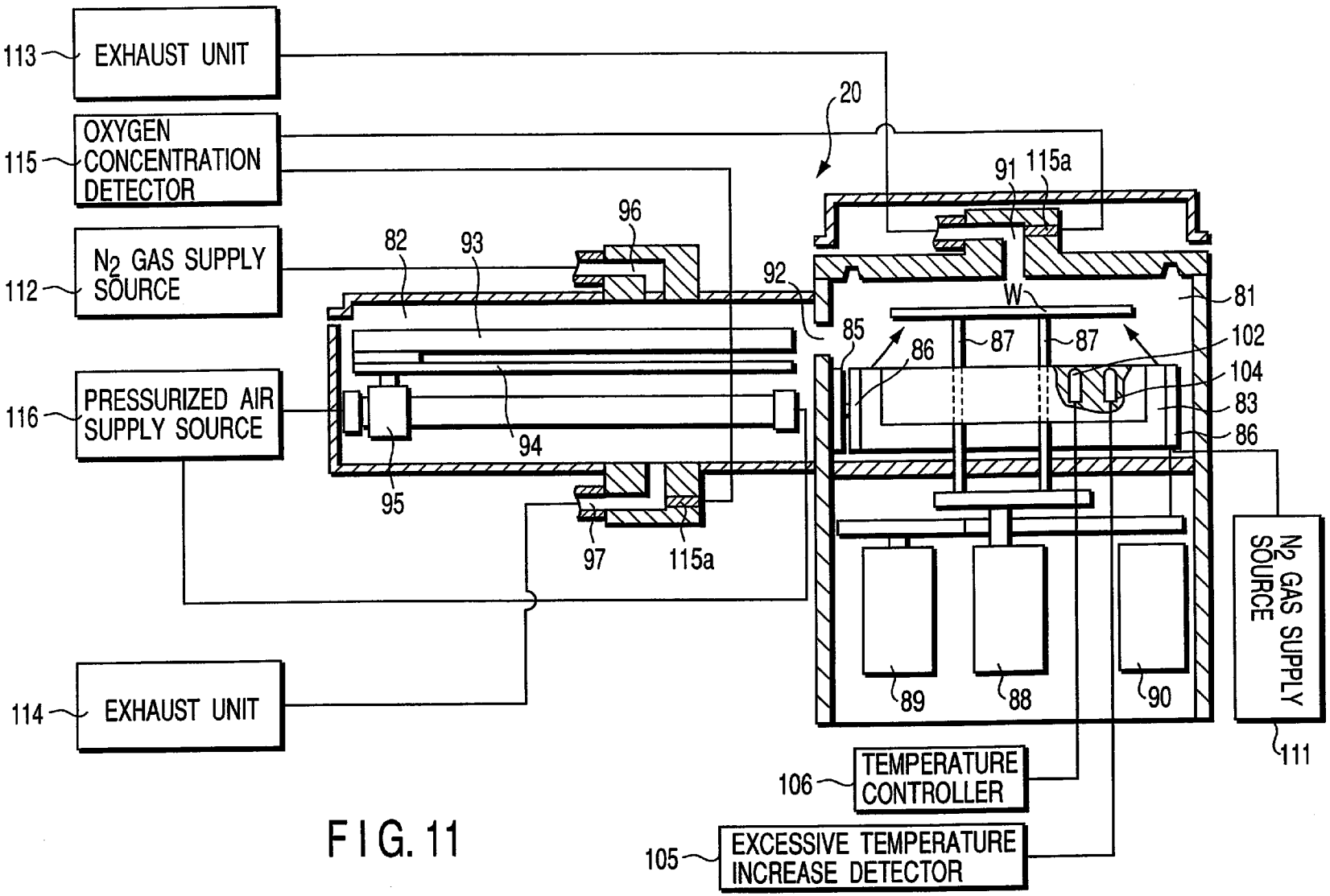
FIG. 11 is a sectional view of the curing process unit (DCC) as viewed from a side with a block diagram of peripheral elements.
Figure 13:
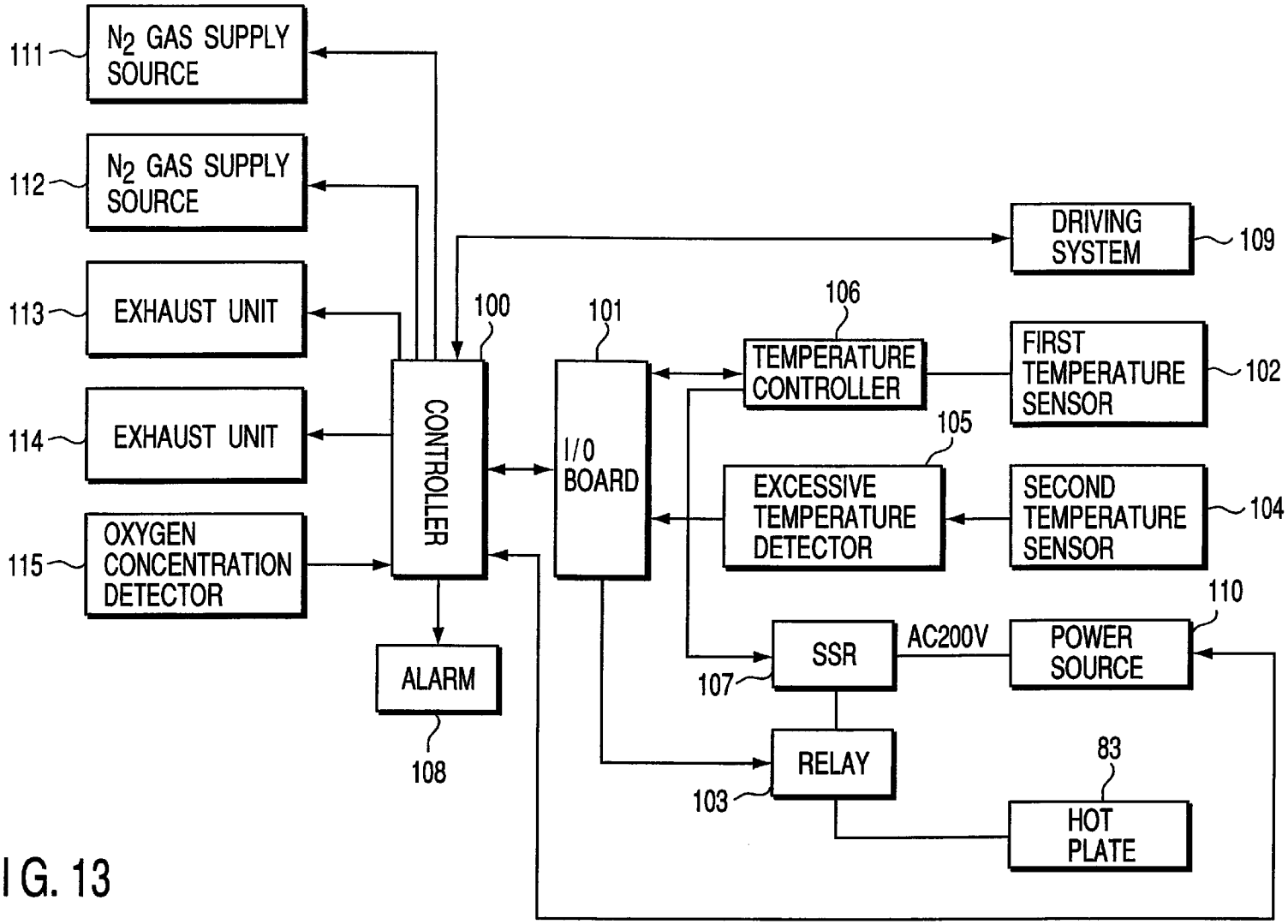
FIG. 13 is a block diagram showing a control circuit of the curing process unit (DCC).

As shown in FIGS. 10 and 11, the DCC process unit 20 has a heating process chamber 81 and a cooling process chamber 82. The heating process chamber 81 has a hot plate 83 capable of setting a temperature at 200–470° C. The hot plate 83 has the first temperature sensor 102 and the second temperature sensor 104 embedded therein to detect the temperature of the hot plate 83. The first temperature sensor 102 is connected to a circuit of a temperature control unit 106. The second temperature sensor is connected to a circuit of an excessive temperature detection unit 105. In this embodiment, a platinum (Pt) resistance temperature sensor is used as the first temperature sensor 102, and a platinum-platinum rhodium series thermocouple is used as the second temperature sensor 104. Note that the first and second temperature sensors 102, 104 may be used either as the resistance temperature sensor or the thermocouple.

The heating process chamber 81 and the cool process chamber 82 are arranged next to each other and communicable with each other through a loading port 92 for loading/unloading the wafer W.

The DCC process unit 20 has first and second gate shutters 84, 85 and a ring shutter 86. The first gate shutter 84 is attached to a loading/unloading port 84*a* of the heating process chamber 81. When the first gate shutter 84 is opened, a loading/unloading port 84*a* is opened to load/unload the wafer W into a heating process chamber 81 by the main transfer mechanism 18. The second gate shutter 85 is provided at the loading/unloading port 92 between the heating process chamber 81 and the cooling process chamber 82 and liftably supported by a cylinder mechanism 89. When the shutter 85 is moved down, the loading/unloading port 92 is opened and when the shutter 85 is moved up, the loading/unloading port 92 is closed.

As shown in FIG. 11, the ring shutter 86 is provided so as to surround the outer periphery of the hot plate 83. The ring shutter 86 and the hot plate 83 are arranged substantially concentrically. The ring shutter 86 and the hot plate 83 are arranged at a relatively equal distance from each other. The rod of the ring shutter 86 is connected to the second gate shutter 85 by means of a member 85*a*. Both shutters 85, 86 are moved together by the cylinder 89.

Figure 12:
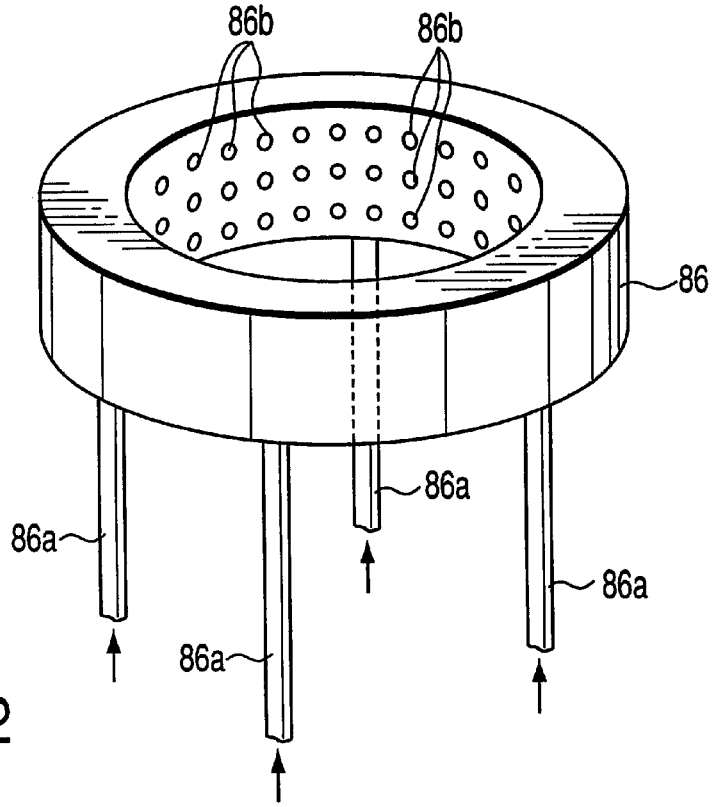
FIG. 12 is a perspective view showing a ring shower nozzle of the curing process unit (DCC)

As shown in FIG. 12, numerous holes 86b are formed in the inner peripheral surface of the ring shutter 86. These holes 86*b* communicate with a gas reservoir in the ring shutter 86 (not shown), which further communicates with a $N_2$ gas supply source 111 (FIG. 11) through a plurality of gas supply pipes 86a. When $N_2$ gas is supplied from the $N_2$ gas supply source 111 to the gas supply pipe 86*a*, the $N_2$ gas is blown out from individual holes 86*b*, uniformly. The gas blow-out holes 86*b* have openings formed virtually horizontally to the ring surface.

The three lift pins 87 are formed on an upper surface (wafer mounting surface) of the hot plate 83 so as to freely protrude or retreat. The lift pins 87 are connected and supported by a rod of a cylinder 88 via a member. Note that a shield-plate screen is provided between the hot plate 83 and the ring shutter 86.

Three cylinder mechanisms 88, 89, 90 are arranged below the heating process chamber 81. The cylinder mechanism 88 moves the lift pins 87 upward and downward. The cylinder mechanism 89 moves the ring shutter 86 and the second gate shutter 85 upward and downward. The cylinder mechanism 90 moves the first gate shutter 84 upward and downward.

As shown in FIG. 11, while $N_2$ gas is supplied from the $N_2$ gas source 111 to the heating process chamber 81 by way of the ring shutter 86, the N gas is exhausted through an upper exhaust pipe 91. The $N_2$ gas supply source 111 and the evacuation unit 113 are controlled by the controller 100 shown in FIG. 13. The controller 100 controls the $N_2$ gas supply source 111 and the evacuation unit 113 synchronously to adjust an inner pressure of the heating process chamber 81 to, for example, 50 ppm or less. Since the inner pressure of the heating process chamber 81 is reduced, the low-oxygen atmosphere is maintained in the heating process chamber 81.

The heating process chamber 81 and the cooling process chamber 82 communicate with each other through the loading/unloading port 92. A cooling plate 93 is movably supported along the guide plate 94 by a horizontal cylinder mechanism 95. The horizontal cylinder mechanism 95 communicates with a pressurized gas supply source 116 serving as a driving source. The cooling plate 93 can enter into the heating process chamber 81 through the loading/unloading port 92 by the cylinder mechanism 95, receives the wafer W which has been heated by the hot plate 83 in the heating chamber 81 from the lift pins 87, and transfers the wafer W into the cooling process chamber 82. After cooling of the wafer W, the wafer W is returned to the lift pin 87.

The cooling plate 93 is set at a temperature of 15 to 25° C. Cool processing is applied to the wafer W if the temperature of the wafer W falls within the range of 200–470° C.

While $N_2$ gas is introduced in the cool processing chamber 82 from a $N_2$ gas supply source 112 through an upper supply pipe 96, it is exhausted from an exhaust unit 114 through a lower exhaust pipe 97. The $N_2$ gas supply source 112 and the exhaust unit 114 are controlled by the controller 100 shown in FIG. 13. The controller 100 controls the $N_2$ gas supply source 112 and the exhaust unit 114 synchronously to adjust the inner pressure of the cooling chamber 82 to, e.g., 50 ppm or less. As described, since the inner pressure of the cooling chamber 82 is reduced, the low-oxygen atmosphere of the cooling chamber 82 can be maintained.

An enzyme sensor 115a is attached to each of the exhaust passages 91, 97 to detect an oxygen concentration of each of the chambers 81, 82 by a oxygen concentration detector 115.

The oxygen concentration detector 115 sends an oxygen concentration detection signal to the controller 100.

Now, a case where an interlayer dielectric film is formed by using the SOD system in accordance with the SiLK method and the SPEED FILM method.

The wafer W is transferred from the carrier station (CSB) 3 to cooling plates (CPL) 24, 26 by way of a transfer section (TRS) 25 and cooled there. Then, the wafer W is transferred to the coating process unit (SCT) 13 and spin-coated with a first coating solution (adhesion promoter solution low in viscosity mainly containing 1-methoxy-2-propanol). The surface of the wafer W is processed with the adhesion promoter solution to thereby strengthen and facilitate adhesion of the interlayer dielectric film (coated in a next step) to the wafer W. Thereafter, the wafer W is controlled in temperature by cooling plates (CPL) 24, 26.

Then, the wafer W is transferred to the coating process unit (SCT) 12 and spin-coated with a second coating solution (solution for the interlayer dielectric film high in viscosity). Furthermore, the wafer w is heated by the hot plates (LHP) 19, 23 to a low temperature and cooled by the cooling plates (CPL) 24, 26.

Particularly in the SiLK method, processing is performed while temperature/humidity in the rotation cup 42, a temperature of a motor flange, and a cooling temperature before coating are controlled integrally. It is therefore possible to suppress occurrence of uneven coating and improve uniformity of film thickness and film quality. If a wafer W is processed in accordance with the SiLK method while temperature/humidity is controlled in the integral controlling mentioned, the uniformity in film thickness and film quality can be greatly improved.

Immediately before the interlayer dielectric film forming solution high in viscosity (second coating solution) is coated, the adhesion promoter (first coating solution) is coated on the wafer W, the adhesion properties can be further improved and thus the first coating step can be omitted. Therefore, improvement of the throughput and reduction in the number of units can be attained.

Then, the wafer W is heated and cooled in the DCC process unit 20 to cure the coating film 203. To explain more specifically, the first gate shutter 84 is first opened. The wafer w is then loaded into the heating process chamber 81 by the transfer mechanism 18 and transferred onto the lift pins 87. The first gate shutter 84 is closed. Then, the ring shutter 86 and the second gate shutter 85 are moved up to surround the wafer W by the ring shutter 86. $N_2$ gas is supplied from the ring shutter 86 to the heating process chamber 81 to set the inner atmosphere thereof at a low oxygen concentration of, e.g., 50 ppm or less.

The wafer W is set closer to the hot plate 83 by moving the lift pins 87 downward and heated under the atmosphere low in oxygen concentration. The heating temperature falls within a predetermined range, for example, 200–470° C. Since the wafer W is heated not in a heating furnace but by the hot plate 83, uniformity in temperature over the surface of the wafer W is good.

After the heating, the ring shutter 86 and the second gate shutter 85 are moved down and the lift pins 87 are moved up. At this time, the $N_2$ gas supply into the heating process chamber 81 is terminated, and simultaneously, the $N_2$ gas supply into the cooling process chamber 82 is initiated. By this operation, the cooling process chamber 82 is maintained at a low oxygen concentration of, e.g., 50 ppm or less. Thereafter, the cooling plate 93 is allowed to enter into the heating chamber 81. The cooling plate 93 receives the wafer w from the lift pins 87 and then the lift pins 87 are moved down.

The cooling plate 93 is returned into the cooling process chamber 82 and the second gate shutter 85 is moved up to cool the wafer W under the atmosphere low in oxygen concentration. At this time, the cooling temperature is, for example, 200–400° C. Since the wafer is cooled in the low oxygen atmosphere, the film is effectively prevented from being oxidized. After the cooling, the $N_2$ gas supply into the cooling process chamber 82 is terminated.

The second gate shutter 85 is moved down to allow the cooling plate 93 to enter into the heating process chamber 81. Then, the lift pins 87 is moved up to transfer the wafer W from the cooling plate 93 to the lift pins 87. Subsequently, the cooling plate 93 is returned to the cooling chamber 82 and then the first gate shutter 84 is opened to unload the wafer W from the heating process chamber 81 by the transfer mechanism 18.

In the aforementioned steps, the heating process and cooling process are completed for curing the coating film 203. After the interlayer dielectric film is completed, the wafer W is returned into the carrier station (CSB) 3 by the transfer mechanism 18 via the transfer section (TRS) 25.

Next, we will explain a case where the interlayer dielectric film is formed by the FOx method in the SOD system.

In the FOx method, an interlayer dielectric film is formed on a wafer W by processing the wafer W in the cooling plates (CPL) 24, 26, the coating process unit (SCT) 12, the low temperature hot plates (LHP) 19, 23, the high temperature hot plate (OHP) 22, and the DCC process unit (DCC) 20, in this order mentioned.

The wafer W is transferred from the carrier station (CSB) 3 to the cooling plates (CPL). 24, 26 by the transfer section (TRS) 25 and cooled therein.

Then, the wafer W is transferred to the coating process unit (SCT) 12 or 13 to coat a coating solution onto the wafer W. The wafer W is heated at a low temperature by the hot plates (LHP) 19 and 23 and then transferred to the cooling plates (CPL) 24, 26 and cooled therein.

Then, the coating film 203 is cured in the DCC process unit 20. More specifically, the wafer W is heated at a temperature within a range of 200–470° C. under the low oxygen atmosphere of, e.g., 50 ppm or less. Then, the wafer W is cooled under the low oxygen atmosphere of, e.g., 50 ppm or less. In this manner, the coating film 203 is cured. After the cooling, the wafer W is returned to the transfer mechanism 18 through the heating process chamber 41. Thereafter, the wafer having the interlayer dielectric film thus completed is returned into the carrier station (CSB) 3 by the transfer mechanism 18 through the transfer section (TRS) 25.

As mentioned in the foregoing, in the SOD system, process units corresponding to various methods such as the Sol-Gel method, the SiLK method, the SPEED FILM method, and the FOx method. Therefore, it is possible to form coating films in accordance with the various methods in a single system.

Since the process units are intensively arranged in the SOD system, the throughput of the coating film is high. In particular, the unit group consisting of the coating process units (SCT) 12, 13 and the liquid process system units such as the solvent exchange unit (DSF) 11 stacked in multiple states and the process unit groups 16, 17 having the heating process system units stacked in multiple stages are provided around the transfer unit 18. Therefore, the system itself is compact and the wafer is transferred between the units in a short time. As a result, the throughput at the time of formation of the coating film can be significantly improved.

Furthermore, the wafer is transferred to/from the carrier station 3 via the transfer section 25 provided in the unit group 17, the wafer W can be smoothly loaded and unloaded.

Furthermore, since two coating process units (SCT) 12, 13 are arranged in the process section 1, it is effective to increase the throughput when two coating processes are performed particularly in the SiLK method and the SPEED FILM method.

Furthermore, two aging units (DAC) 21 and two DCC process units 20 are arranged. Therefore, it is possible to avoid a decrease in throughput in these processes.

Objects to be processed in the apparatus of the present invention include an LCD substrate other than a semiconductor wafer.

The coating films formed by using the apparatus of the present invention include a passivation film and a side wall spacer film other than the interlayer dielectric film.

Since the apparatus of the present invention has the process sections which can correspond to any one of the methods including the Sol-Gel method, SiLK method, SPEED FILM method and FOx method. Different types of films can be formed in accordance with these various methods by using the apparatus of the present invention alone.

Furthermore, a plurality of liquid process system units are stacked vertically in multiple stages and integrated as a plurality of process unit groups, so that the transfer time of the substrate is reduced and the throughput in the coating film formation process is improved.

In the apparatus of the present invention, since the heating process section is arranged next to the chemical solution vapor generating section, vapor of a chemical solution is not condensed within a supply pipe.

Furthermore, in the apparatus of the present invention, the chemical solution vapor generating section and the waste liquid/exhaust gas section are arranged away from the carrier station. Therefore, unprocessed substrate and processed substrates may not be polluted with the chemical solution and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for forming a coating film, comprising;

a process section for applying a series of processes for forming a coating film to a substrate; and a common transfer mechanism for transferring the substrate in the process section, wherein the process section comprises, a cooling unit for cooling the substrate;

a coating unit for applying a coating solution containing a first solvent to the substrate to form a coating film;

an aging unit for changing the coating film formed in the coating unit to a gel-state film;

a solvent exchange unit for bringing a second solvent, which differs from the first solvent in composition, into contact with the coating film to replace the first solvent contained in the coating film with the second solvent;

a curing process unit for heating and cooling the substrate under an atmosphere in low oxygen concentration, thereby curing the coating film; and a heating unit for heating the coating film formed on the substrate.

2. The apparatus according to claim 1, further comprising, a carrier station provided next to the process section for loading/unloading an unprocessed substrate and a processed substrate into/from the process section; and a transfer section for transferring a substrate between the carrier station and the process section.

3. The apparatus according to claim 1, wherein the process section has at least two coating units.

4. The apparatus according to claim 1, wherein the process section has a first coating unit for coating an adhesion promoter solution low in viscosity, on the substrate, and a second coating unit for coating an interlayer dielectric film formation solution high in viscosity, on the substrate.

5. The apparatus according to claim 1, wherein the process section has at least two aging units and at least two curing process units.

6. The apparatus according to claim 1, wherein the solvent exchange unit, the coating unit, the aging unit are arranged next to each other.

7. The apparatus according to claim 1, further comprising a side cabinet provided next to the process section, the side cabinet comprising a bubbler for generating a vapor of a chemical liquid and supplying the vapor of a chemical liquid generated, to the aging unit;

a trap section for trapping a waste and a discharge gas derived from the solvent exchange unit, the aging unit, and the coating unit; and a drain section for discharging a liquid component separated from a gaseous component in the trap section.

8. The apparatus according to claim 7, wherein the bubbler is arranged next to the heating unit.

9. The apparatus according to claim 7, wherein the process section has a first coating unit for coating an adhesion promoter solution low in viscosity, on the substrate and a second coating unit for coating an interlayer dielectric film formation solution high in viscosity, on the substrate; and each of the first coating unit and the solvent exchange unit is arranged next to the side cabinet.

10. The apparatus according to claim 7, wherein the side cabinet is isolated from the carrier station by the process section.

11. The apparatus according to claim 4, wherein the second coating unit has temperature control means for controlling a temperature of the interlayer dielectric film forming solution.

12. The apparatus according to claim 1, wherein the solvent exchange unit has temperature control means for controlling temperature of the second solvent.

13. An apparatus for forming a coating film comprising:

a process section for applying a series of processes for forming a coating film, to a substrate; and a common transfer mechanism for transferring the substrate in the process section, wherein the process section comprises, a first process unit group including, a coating unit for coating a coating solution containing a first solvent onto the substrate; and a solvent exchange unit for bringing a second solvent, which differs from the first solvent, in composition, into contact with the coating film to replace the first solvent in the coating film with the second solvent; and a second process unit group including, a cooling unit for cooling the substrate;

a heating unit for heating the substrate;

an aging unit for changing the coating film to a gel-state film; and a curing process unit for heating and cooling the substrate under an atmosphere low in oxygen concentration to cure the coating film, the common transfer mechanism is provided next to the first and second process unit groups for transferring the substrate to at least a coating unit, solvent exchange unit, cooling unit, heating unit, aging unit, and curing process unit.

14. An apparatus for forming a coating film comprising a process section for applying a series of processes for forming a coating film to a substrate;

a common transfer mechanism for transferring the substrate in the process section; and a chemical liquid section provided next to the process section while isolated therefrom;

wherein the process section comprises a coating unit for coating a coating solution of a sol state having particles or colloid dispersed in a solvent, onto the substrate;

an aging unit for changing the particles or colloid in the coating film into a gel; and a solvent exchange unit for replacing a solvent in the coating film with another solvent, the chemical liquid section has a chemical liquid supply system for supplying a chemical liquid to each of the aging unit and the solvent exchange unit; and a waste liquid gas process system for discharging a waste and an exhaust gas derived from the aging unit and the solvent exchange unit.

15. The apparatus according to claim 14, wherein the solvent exchange unit, the coating unit and the aging unit are arranged next to each other.

16. The apparatus according to claim 14, wherein the chemical liquid section generates a vapor of the chemical liquid and has a bubbler for supplying the vapor of the chemical liquid to the aging unit.

17. The apparatus according to claim 14, wherein the chemical liquid section has a tank for storing the chemical liquid to be supplied to the solvent exchange unit.

18. The apparatus according to claim 14, wherein the chemical liquid section has a drain tank for trapping a waste discharged from the aging unit.

19. The apparatus according to claim 14, wherein the chemical liquid section has a drain tank for trapping a waste discharged from the aging unit; and a trap section communicating with the drain tank and the solvent exchange unit for separating the waste discharged from the solvent exchange unit into a gaseous component and a liquid component and sending the liquid separated to the drain tank.

* * * * *